US006485020B1

(12) United States Patent
Broadnax

(10) Patent No.: US 6,485,020 B1
(45) Date of Patent: Nov. 26, 2002

(54) CASINO CARD GAME

(76) Inventor: John Broadnax, P.O. Box 11951, Zephyr Cove, NV (US) 89448

( * ) Notice: Subject to any disclaimer, the term of this patent is extended or adjusted under 35 U.S.C. 154(b) by 0 days.

(21) Appl. No.: 09/758,056

(22) Filed: Jan. 10, 2001

Related U.S. Application Data

(60) Provisional application No. 60/175,296, filed on Jan. 10, 2000.

(51) Int. Cl.[7] ..... A63F 1/00
(52) U.S. Cl. ..... 273/292
(58) Field of Search ..... 273/292, 274; 463/12, 13

(56) References Cited

U.S. PATENT DOCUMENTS 5,407,209 A * 4/1995 Prerost
5,615,888 A * 4/1997 Lofink et al.
5,653,445 A * 8/1997 Quach
5,829,750 A * 11/1998 Booker
5,839,730 A * 11/1998 Pike

* cited by examiner

*Primary Examiner*—Benjamin H. Layno
(74) *Attorney, Agent, or Firm*—Charles C. Logan II

(57) ABSTRACT

A method of playing a card game based upon various options that a player can make to the standard card game of Black Jack. It utilizes a game board having multiple wagering circles each identified by a number that represents the option the player may choose. The ability to exercise the options does not come into play until at two cards have been dealt to each player and also to the dealer in the conventional manner of playing Black Jack.

17 Claims, 2 Drawing Sheets

CASINO CARD GAME

This is a application claims benefit of Provisional Application No. 60/175,296 filed Jan. 10, 2000.

FIELD OF THE INVENTION

The invention relates to the field of card games, and more specifically to a game based upon various options that a player can make to the conventional game of Black Jack.

BACKGROUND OF THE INVENTION

The game of Black Jack or Twenty-one has been played for over 100 years in its standard form. It is one of the mainstays of the casino industry which is always looking for new gambling games that will appeal to their cliental One of the new games recently invented is disclosed in U.S. Pat. No. 5,695,192. It combines the play of the Black Jack card game with a pair of dice each having six faces that are numbered one through six.

In the casino industry there is a premium on floor space. Each square foot must generate income, particularly in Colorado where gaming foot space is statutorily limited, and in Louisiana where the river boats are comparatively small. The challenge is to generate the maximum plays per hour in order to achieve the odds advantage built into the game, otherwise one big win would sink the house because the overhead would bury it.

The game of "21" of "Black Jack" is the fastest in the casino. The invention allows more plays within the play, thus is optimizing the odds spread.

It is an object of the invention to provide a novel card game that expands the options currently available to persons presently playing the game of Black Jack or Twenty-one.

It is also an object of the invention to provide a novel card game that expands the casino's potential to generate increased revenue from the standard game of Black Jack or Twenty-One.

It is another object of the invention to provide a novel card game that can be quickly learned by players of the card game Black Jack or Twenty-One.

It is an additional object of the invention to provide a novel card game whose game board would be inexpensive for the casinos to purchase.

It is a further object of the invention to provide a novel card game that would be easy for Black Jack dealers to master quickly.

SUMMARY OF THE INVENTION

This novel game is based upon the principal of Black Jack, with several variations. The game presents the player with multiple choices of ways to conceivably make the best hand possible, or at least to have more than one chance at doing so.

The game allows a player to:

1. Replace one of the first two cards dealt.
2. Replace the first double down card dealt.
3. Draw second double down hit card in addition to the first double down card dealt.
4. Draw a replacement card for the hit card that busts the player's hand.
5. If a player is unhappy with the first two cards dealt, the player may surrender half of his bet and withdraw from the game.

A player may use as many of these options as the player's hand will allow.

The game is played with a standard four suit 2–10, Jack, Queen, King and Ace deck or multiple such decks. It also has a game board in form of a felt or other type of material cover on which is printed one or more player areas each having multiple symbols and indicia upon which wagers are placed to exercise the various options available to the player.

BASIC RULES

The players are dealt two cards each and may decide at that time whether to select from those options or play the hand out according to the casino's rules for Black Jack.

1. Option One: Replace one of the first two cards dealt. Player must place a bet equal to the original bet in the appropriate circle for replacing one of the first two cards dealt. The dealer will then remove the designated card and replace it with a new card from the deck. This process can only be done once.

2. Option Two: Replace the first double down hit card. Player must place a bet equal to the original bet in the appropriate circle for replacing the first double down card. This process can only be done once.

3. Option Three: Receive a second double down card in addition to the first double down card. Player must place a bet equal to the original bet in the appropriate circle for drawing a second double down card. The dealer will then draw a card from the deck and place it below the first double down card, making what has now become a second double down hand when you combine this last card with the original two cards dealt. The drawing of a second double down card can only be done if the dealer has a face card or ace showing, the dealers first double down hand must total 20 or 21.

4. Option Four: Draw a replacement card for a bust card. Player must place a bet equal to the original bet in the appropriate circle for replacing a bust card. The dealer will then remove the bust card and replace it with a new card from the deck. This process can only be done once.

5. Option Five: A player may surrender a hand. To do so a player must forfeit one-half of his original bet and surrender his cards to the dealer immediately. The option to surrender can only be made on the first two cards dealt to the player.

PROCEDURES

1. Each player must place the required bet in the appropriate spot for his player position in order to be in play and be entitled to use the available options.

2. The dealer will give each player one card face up, dealing from his left to his right, with the dealer receiving the last card face down.

3. The dealer will repeat the process until each player has two cards face up and the dealer turns his second card face up.

4. The player may now make his decision as to how he will play the game by either placing a bet in the option circle of his choice, or, to not do so would indicate to the dealer that he chooses to play without benefit of the options.

5. The dealer must determine if he has a Black Jack before play continues. Black Jack can only be paid one and one-half (1.5) times the bet if received on the first two original cards dealt.

REVIEW OF RULES

1. Black Jack can only be paid on the first two original cards dealt to a player.

2. Player may double down on ten or eleven only.

3. Player may replace the bust card only once.

4. If the first two cards make a pair and the player wants to split them, he may do so but cannot use the options.

5. Double down bets must equal the original bet.

6. Pushes—all bets forfeited by the player because he chose to use an option will remain forfeited in the event of a push with the dealer.

7. Option 2—Replacing the double down card can only happen once per hand.

8. Option—3 Receiving a second double down card can only happen if the dealer has an ace or face card showing, and only if the player's first double down hand is 20 or 21.

EXAMPLES OF OPTION USE

1. OPTION ONE: Player is dealt 2 cards, a 10 and a 5 for a total of 15. The player decides to use option one and places a bet equal to the original bet in circle #1. The dealer takes down the original bet, which is forfeited, and removes the unwanted card (the 5) and replaces it with another card from the deck. This completes the use of option one.

2. OPTION TWO: Player is dealt cards 2 cards, a 5 and a 6, for a total of 11. The player matches the original bet, and doubles down, receiving an ace from the dealer. The player decides to use option two and places a bet equal to the original bet in circle #2. The dealer removes the original double down bet, which is forfeited, and the first double down card, replacing it with another card from the deck This completes the use of option two.

3. OPTION FOUR: The player is dealt 2 cards, a Jack and a 3 for a total of 13. The player decides to hit and receives a 9, which makes a busted hand of 22. The player decides to use option four. He places a bet equal to the original bet in circle #4. The dealer removes the original bet, which is forfeited, removes the bust card, and replaces it with another card from the deck. Depending on the value of the card, the player may continue to hit or stand. This completes the use of option four.

4. OPTION THREE: The player is dealt 2 cards, a 7 and a 4, for a total of 11the deal has an ace showing. The player matches the original bet and doubles down receiving a 10, making a hand of 21. The player decides to use option three and places a bet equal to the original double down bet in circle #3. The dealer gives the player an additional double down card from the deck. The player now has a second double down hand. This completes the use of option three.

OTHER RULES

Splitting pairs may be done up to four hands. Once a pair has been split, the player may use any of the options that apply. For example, a player may decide to split a pair of 6's. The next two cards dealt are also 6's, and the player decides to split each of them making four hands. The first card dealt to the first 6 is a 10. The player decides to exercise option one and the dealer removes the 6 and replaces it with a 9, making a hand of 19. The player moves on and the first card dealt to the second 6 is a 4, making a hand of 10. The player doubles down receiving a 5, and decides to exercise option two. The dealer replaces the first double down card with a 9, making a hand of 19. The player moves on and the first card dealt to the third 6 hand is a 5, making a hand of 11. The player doubles down and receives a King, making a hand of 21. The dealer has an Ace showing, and the player decides to exercise option three. The dealer places an additional card on top and below the original double down card, making what is now two double down hands. The player moves on to the fourth and last 6 hand. The first card dealt to the last 6 is a 7, for a hand of 13. The player hits again and receives a 2, making the hand 15. He hits again and receives a queen, which makes a busted hand of 25. The player decides to use option four. The dealer replaces the queen (bust card) with a 5, making a hand of 20.

Double Down. Players may double down on any two cards.

Bust Card. The bust card may only be replaced once.

This game will be played with a standard four suit 2–10, Jack, Queen, King,

Ace deck or multiple decks in a show.

There are numerous variants comprehended in the invention. This invention has been described by reference to specific examples and embodiments, which will bring alternative embodiments, modifications and variations to the minds of those skilled in the art. The claims filed in the patent application are intended to encompass all such alternatives, modifications, and variations.

DESCRIPTION OF THE PREFERRED EMBODIMENT

Figure 1:
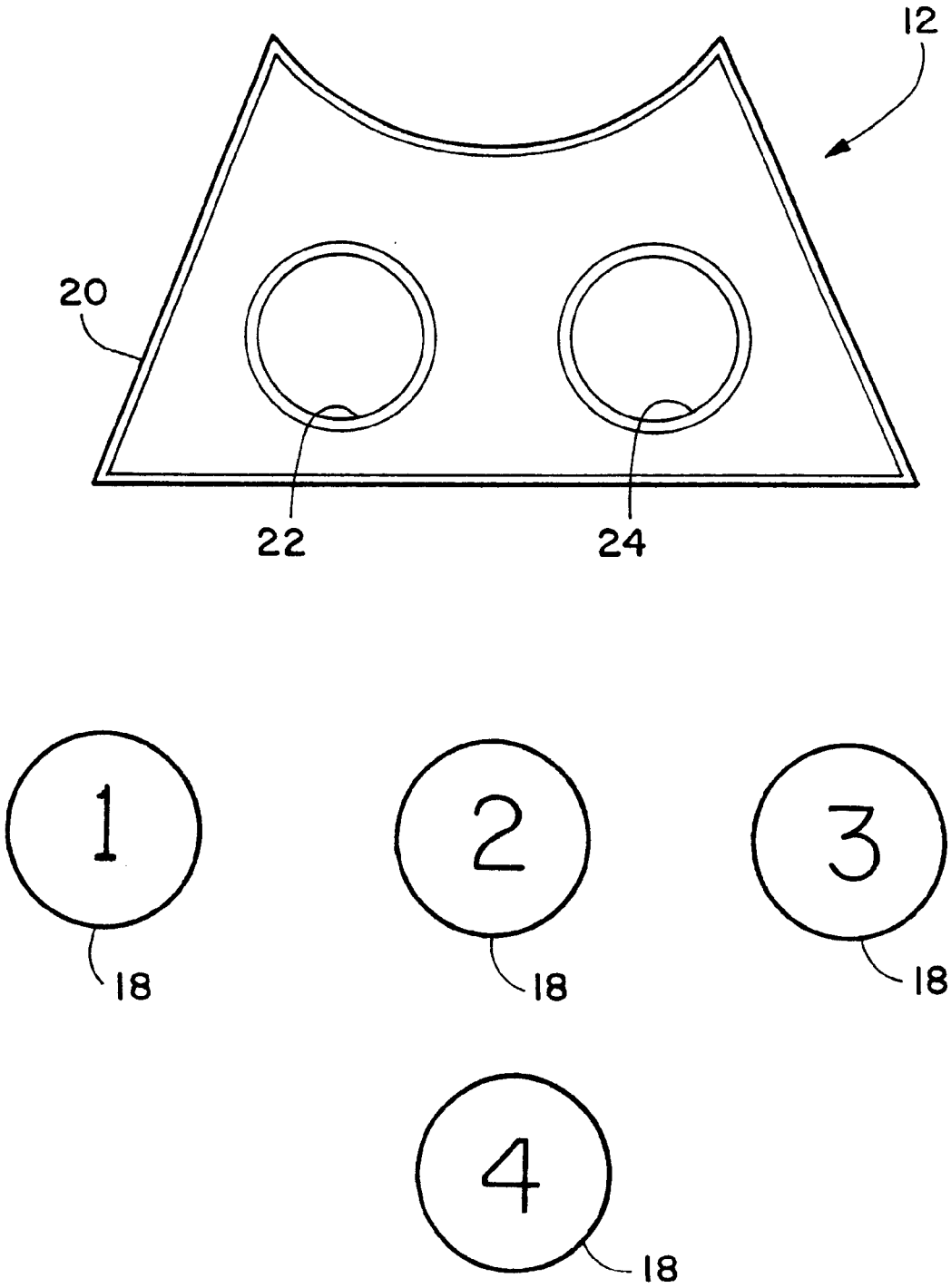
FIG. 1 is a top plan view of one of the individual player areas.
Figure 2:
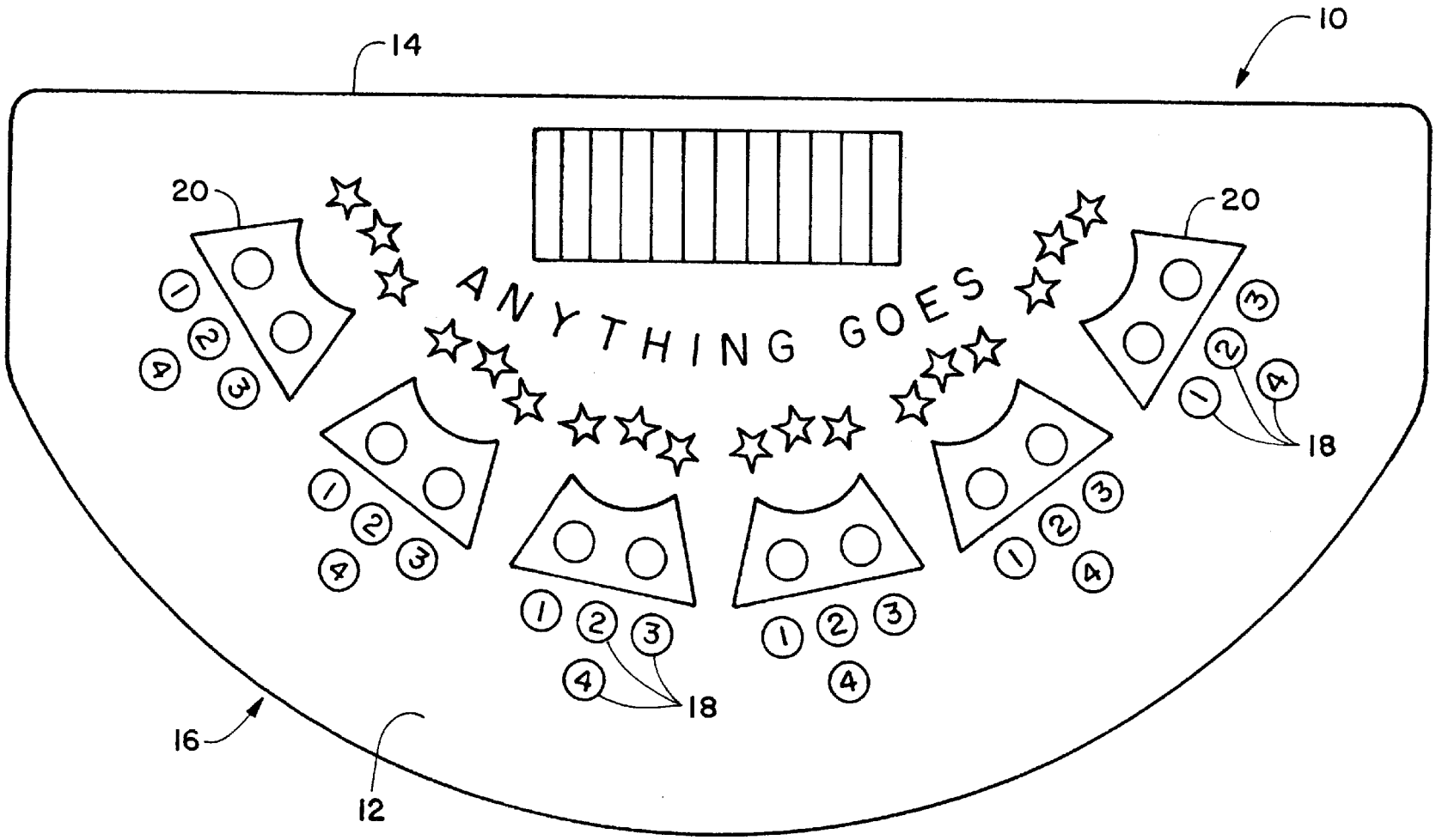
FIG. 2 is top plan view of the game board illustrating five individual player areas.

The game board 10 and the individual player areas 12 will now be described by referring to FIGS. 1 and 2 of the drawings. The game board 10 has a straight diameter edge 14 and a semi-circular playing area 16. The dealer's playing area is centrally located adjacent straight diameter edge 14. The player areas are spaced around the periphery of semi-circular playing area 16.

The player areas 12 each have four option wager circles 18 within which is printed a number that refers to an option that the player may exercise. Spaced above the option wager circles 18 is a truncated triangle 20 having two circles printed therein. Circle 22 is where a player's original bet is placed and circle 24 is where a player's double down bet is placed.

The manner in which the game is played has been thoroughly discussed previously in the summary of the invention.

What is claimed is:

1. A method of playing a modified Black Jack game of cards using at least one standard deck of playing cards having the standard four suit 2–10, jack, queen, king and ace playing cards; said method utilizing a game board having a dealer playing area and multiple player areas; each player area having multiple wagering places each identified by an indicia; said method comprising:

a) establishing an original wager by each card player;

b) dealing at least two cards to each player and also to the dealer in the conventional manner of playing Black Jack; and c) each player may when it is his turn exercise Option One that involves replacing one of the first two cards dealt to the player; the player must place a bet equal to his original bet on the appropriate indicia mark that identifies Option One; the dealer will then remove the designated card and replace it with a new card from said deck.

2. The method of claim 1 wherein Option One can only be done once.

3. The method of claim 1 wherein the indicia mark on said game board for Option One is a circle with the number one inside.

4. The method of claim 1 wherein a player may surrender said hand by informing said dealer that he is exercising an option and to do so said player must forfeit one-half of his original bet and surrender his cards to the dealer immediately; said player may surrender on the first two original cards only.

5. The method of claim 4, wherein said option can only be made on the first two cards dealt to said player.

6. The method of claim 1, wherein Black Jack can only be paid on said first two original cards dealt to a player.

7. The method of claim 1, wherein if said player's first two cards make a pair, said player may split them, but he cannot exercise any option to replace a card.

8. The method of claim 1, wherein all bets forfeited by said player because he chose to use an option will remain forfeited in the event of a push with the dealer.

9. A method of playing a modified Black Jack game of cards using at least one standard deck of playing cards having the standard four suit 2–10, jack, queen, king and ace playing cards; said method utilizing a game board having a dealer playing area and multiple player areas; each player area having multiple wagering places each identified by an indicia; said method comprising:

a) establishing an original wager by each card player;

b) dealing at least two cards to each player and also to the dealer in the conventional manner of playing Black Jack; and c) wherein a player with a hand of 10 or 11 may, when it is his turn, match the original bet and direct the dealer to issue him a first double down hit card; if dissatisfied with the first double down hit card, the player may exercise an option by placing a bet equal to the original bet on the appropriate indicia mark that identifies said option; the dealer will then remove said first double down hit card and replace it with a new card from said deck.

10. The method of claim 9 wherein said option can only be done once.

11. The method of claim 9, wherein the indicia mark on said game board for said option is a circle with the number two inside.

12. A method of playing a modified Black Jack game of cards using at least one standard deck of playing cards having the standard four suit 2–10, jack, queen, king and ace playing cards; said method utilizing a game board having a dealer playing area and multiple player areas; each player area having multiple wagering places each identified by an indicia; said method comprising:

a) establishing an original wager by each card player;

b) dealing at least two cards to each player and also to the dealer in the conventional manner of playing Black Jack; and c) wherein a player when it is his turn directs the dealer to issue him a hit card that brings said player's total to a sum greater than 21 and said last card is known as a bust card and said player exercises an option by placing a bet equal to said original bet on the appropriate indicia mark that identifies said option; said dealer will then remove said bust card and replace it with a new card from said deck; depending on the value of the replacement hit card said player may draw additional hit cards, but may replace the bust card only once.

13. The method of claim 12, wherein said option can only be done once.

14. The method of claim 12, wherein said the indicia mark on said game board for said option is a circle with the number four inside.

15. A method of playing a modified Black Jack game of cards using at least one standard deck of playing cards having the standard four suit 2–10, jack, queen, king and ace playing cards; said method utilizing a game board having a dealer playing area and multiple player areas; each player area having multiple wagering places each identified by an indicia; said method comprising:

a) establishing an original wager by each card player;

b) dealing at least two cards to each player and also to the dealer in the conventional manner of playing Black Jack; and c) when it is his turn each player with a two card hand of 10 or 11, may direct the dealer to issue him a first double down card and if the hand totals 20 or 21 and the dealer has an Ace or face card up, said player may exercise an option by placing a bet equal to the original bet on the appropriate indicia mark that identifies said option; the dealer will issue said player a second double down card from said deck and place it below said first double down card, making what has now become a second double down hand when you combine said last card with said original two cards dealt; the drawing of a second double down card can only be done if said dealer has a face card or ace showing.

16. The method of claim 15, wherein said option can only be done once.

17. The method of claim 15 wherein said indicia mark on said game board for said option is a circle with the number three inside.

* * * * *